United States Patent [19]

Jaqua

[11] 4,389,999

[45] Jun. 28, 1983

[54] ULTRASONIC CHECK VALVE AND DIESEL FUEL INJECTOR

[75] Inventor: Vance W. Jaqua, Canoga Park, Calif.

[73] Assignee: Rockwell International Corporation, El Segundo, Calif.

[21] Appl. No.: 378,544

[22] Filed: May 17, 1982

Related U.S. Application Data

[63] Continuation of Ser. No. 179,325, Aug. 18, 1982, abandoned.

[51] Int. Cl.[3] ..... F02M 47/00; F02B 7/00

[52] U.S. Cl. ..... 123/536; 123/539; 251/129; 239/102

[58] Field of Search ..... 123/536, 538, 539, 590, 123/470, 472, 494; 251/129; 239/102

[56] References Cited

U.S. PATENT DOCUMENTS

| | | | |
|---|---|---|---|
| 2,902,251 | 9/1959 | Oncley | 251/129 |
| 2,949,900 | 8/1960 | Bodine | 123/472 |
| 3,029,743 | 4/1962 | Johns | 251/129 |
| 3,034,760 | 5/1962 | Henrion | 251/129 |
| 3,055,631 | 9/1962 | Kippenhan | 251/129 |
| 3,451,379 | 6/1969 | Kuribayushi et al. | 123/538 |
| 3,857,543 | 12/1974 | McKeen | 251/129 |
| 3,884,417 | 5/1975 | Sheffield et al. | 251/129 |
| 4,158,368 | 1/1979 | Clark | 251/129 |

*Primary Examiner*—Raymond A. Nelli

*Attorney, Agent, or Firm*—H. Fredrick Hamann; Harry B. Field

[57] ABSTRACT

An ultrasonic diesel fuel injector comprises an injector body including a means for flowing fuel through the injector body, a check valve located within the means for flowing fuel, and a means for ultrasonically vibrating the check valve.

5 Claims, 4 Drawing Figures

Fig. 1
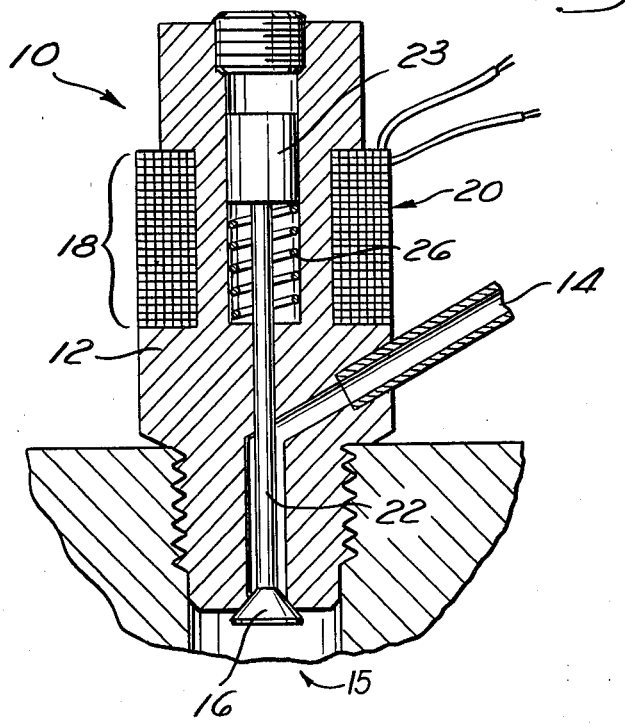
Fig. 2a
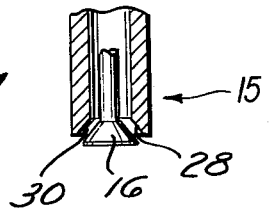
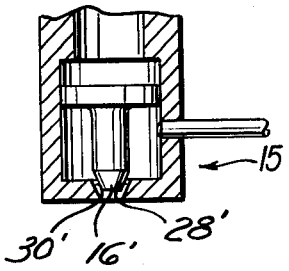
Fig. 2b
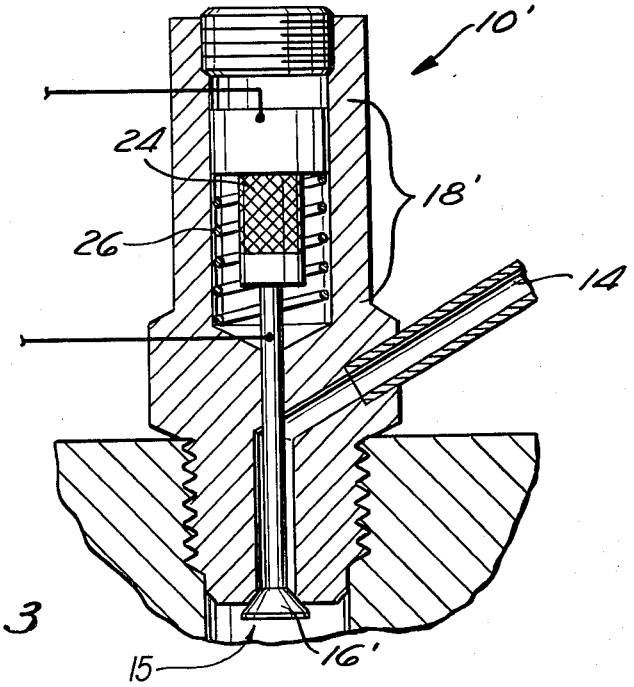
Fig. 3

ULTRASONIC CHECK VALVE AND DIESEL FUEL INJECTOR

This is a continuation of application Ser. No. 179,325, filed Aug. 18, 1982, now abandoned.

BACKGROUND OF THE INVENTION

1. Field of the Invention

The present invention pertains to diesel engines and, more specifically, to ultrasonic fuel injectors.

2. Description of the Prior Art

Diesel engines designed according to the precombustion chamber system have the combustion chamber divided into a precombustion chamber, which is incorporated into the cylinder head, and a main combustion chamber which is positioned between the bottom edge of the cylinder head and the head or crown of the piston. The precombustion chamber into which the fuel is injected and in which combustion initially takes place, is connected to the main combustion chamber by means of a narrow slot or flow passage.

In operation, as the piston moves in the direction of the cylinder head air is forced into the precombustion chamber, and near the end of this compression stroke fuel is injected into the precombustion chamber. Subsequently, the combustion products are returned through the flow channel from the precombustion chamber into a secondary combustion chamber formed in the piston head. The combustion of this fuel-air combination generates the thrust necessary to produce the power stroke of the piston.

It should be noted that although U.S. Pat. No. 4,122,804 to Kingsbury et al describes a diesel engine designed in accordance with precombustor theory and having a precombustion chamber using a pencil-type fuel injector, Kingsbury et al does not teach a system for ultrasonically injecting fuel into the combustion chamber.

SUMMARY OF THE INVENTION

Accordingly, there is provided by the present invention a means of introducing ultrasonic vibrational energy into a diesel fuel injector. The injector comprises a body which houses a fuel inlet means, a check valve head oriented within the fuel inlet, and a means for inducing high-amplitude, high-frequency oscillations into the check valve head.

OBJECTS OF THE INVENTION

Therefore, it is an object of the present invention to incorporate an ultrasonic transducer into a check valve of a diesel injector.

Another object of the present invention is to provide an ultrasonic means for atomizing fuel.

Yet another object of the present invention is to provide a high-efficient diesel engine.

Another object of the present invention is to provide a diesel engine which burns fuel more completely.

Still another object of the present invention is to provide a diesel engine whose particulate matter output is significantly decreased.

Yet another object of the present invention is to provide a diesel engine which decreases the production of nitrogen oxides.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic cross-sectional view of an injector having a magnetostrictive-driven check valve head.

FIG. 2*a* is a schematic view of a poppet valve incorporated in the injector.

FIG. 2*b* is a schematic view of a pintle valve incorporated in the injector.

FIG. 3 is a schematic cross-sectional view of an injector having a piezoelectric-driven check valve.

The same elements or parts throughout the figures of the drawings are designated by the same reference characters, while equivalent elements bear a prime designation.

DESCRIPTION OF THE PREFERRED EMBODIMENTS

Turning now to FIG. 1, there is shown a first ultrasonic diesel fuel injector 10. Injector 10 comprises injector body 12 which houses fuel inlet means 14, check valve generally designated at 15 and having check valve head 16, and means for inducing high-amplitude, high-frequency oscillations 18 into check valve head 16. Functional check valve heads include by the poppet-type, as shown in FIG. 2*a*, and the pintle-type shown in FIG. 2*b*.

In FIG. 1, means for inducing high-amplitude, high-frequency oscillations 18 comprises drive coil 20, check valve shaft 22 which comprises a magneto strictive material, and backing stub 23 which comprises a non-magnetostrictive material. As described in copending application U.S. Ser. No. 156,987 filed June 6, 1980, entitled Ultrasonic Diesel Fuel Injector, by Bruce W. Maynard, Jr. et al, included herein by reference, the check valve will, depending upon specific request, be driven at a frequency ranging from about 10 to about 10,000 kilocycles.

Turning now to FIG. 3, there is shown an injector 10' which differs from injector 10 only in the means for inducing high-amplitude, high-frequency oscillations 18' into check valve head 16'. In this embodiment, a piezoelectric element 24 is used to provide the high-frequency oscillations required to atomize the fuel instead of the magnetostrictive-driven poppet valve head 16.

Although many various operational modes will provide the desired atomization, the preferred operational sequence is as follows: Fuel flows through inlet means 14 causing check valve 15 to open against conventional biasing means 26. In the open position, FIGS. 2*a* and 2*b*, check valve head 16,16' is displaced from valve seat 28,28' by a gap 30,30', of about two-thousandths of an inch in size. Once check valve 15,15' is open, the means 18,18' for inducing the high-amplitude, high-frequency oscillations is activated. After a predetermined amount of fuel has been injected, means 18,18' can be turned off and valve 16,16' is closed.

Although the preferred operational mode described above teaches a specific sequential operation in conjunction with an on/off ultrasonic vibrational mode, it should be noted that neither the specific sequence described nor the specific on/off mode must be followed, since different situations could require different operational modes for the subject injectors, 10,10'.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. An ultrasonic fuel injector suitable for use in a diesel, comprising:

an injector body, conduit means for allowing a flow of fuel to pass through said injector body, and a check valve comprising a valve seat at a point along said conduit means, a check valve head engageable with said valve seat to close-off said conduit means, said check valve head being moveable to a disengaged position with respect to said valve seat, biasing means for urging said check valve head to return to engagement with said valve seat after passage of said flow of fuel, means for connecting said check valve body to said biasing means and means for applying ultrasonic vibration to said check valve head through said connecting means while said check valve head is in said disengaged position, so that said flow of fuel is atomized.

2. The ultrasonic injector of claim 1 wherein said check valve comprises a poppet valve.

3. The ultrasonic injector of claim 1 wherein said check valve comprises a pintle valve.

4. A fuel injector as claimed in claim 1 wherein said connecting means comprises a stud and a magnetostrictive shaft member, said magnetostrictive shaft member being connected at one end to said stud and at the opposite end to said check valve head, said biasing means comprises a spring acting between said injector body and said stud, and said means for applying ultrasonic vibration comprises a drive coil in proximity to said magnetostrictive shaft member of said connecting means.

5. A fuel injector as claimed in claim 1 wherein said connecting means is a member comprising a stud, a shaft connected to said check valve head and a piezoelectric element between said stud and said shaft, said means for applying ultrasonic vibration to said check valve head comprising said piezoelectric element.

* * * * *